US007621521B2

(12) United States Patent
Koga et al.

(10) Patent No.: US 7,621,521 B2
(45) Date of Patent: Nov. 24, 2009

(54) SHEET FEEDING UNIT, SHEET FEEDING APPARATUS, AND IMAGE FORMING APPARATUS

(75) Inventors: Hiroto Koga, Abiko (JP); Yusuke Imai, Toride (JP); Hiroshi Hiura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/177,757

(22) Filed: Jul. 22, 2008

(65) Prior Publication Data

US 2008/0277862 A1 Nov. 13, 2008

Related U.S. Application Data

(63) Continuation of application No. 11/466,557, filed on Aug. 23, 2006, now Pat. No. 7,451,973.

(30) Foreign Application Priority Data

Aug. 30, 2005 (JP) ..... 2005-249276
Oct. 19, 2005 (JP) ..... 2005-304258

(51) Int. Cl.
*B65H 3/14* (2006.01)

(52) U.S. Cl. ..... 271/97; 271/98

(58) Field of Classification Search ..... 271/97, 271/98; 347/104
See application file for complete search history.

(56) References Cited

U.S. PATENT DOCUMENTS

| | | | | |
|---|---|---|---|---|
| 7,140,605 | B2 * | 11/2006 | Suga et al. | 271/97 |
| 2004/0253032 | A1 | 12/2004 | Kojima | |
| 2005/0046104 | A1 | 3/2005 | Suga | |

FOREIGN PATENT DOCUMENTS

| | | |
|---|---|---|
| JP | 63-001825 | 1/1988 |
| JP | 11-059925 | 3/1999 |
| JP | 2001-048366 | 2/2001 |
| JP | 2003-165641 | 6/2003 |
| JP | 2005-001784 | 1/2005 |
| JP | 2005-096993 | 4/2005 |

* cited by examiner

*Primary Examiner*—Patrick H Mackey
*Assistant Examiner*—Luis Gonzalez
(74) *Attorney, Agent, or Firm*—Canon USA Inc IP Div

(57) ABSTRACT

A feeding unit is detachably attached to a sheet cassette in which sheets are loaded. The feeding unit includes a sheet tray on which sheets are loaded, and a fan for blowing air against the side surface of a stack of sheets loaded on the sheet tray, the sheet tray and the fan being held in a case.

8 Claims, 14 Drawing Sheets

SHEET FEEDING UNIT, SHEET FEEDING APPARATUS, AND IMAGE FORMING APPARATUS

CROSS-REFERENCE TO RELATED APPLICATIONS

This application is a continuation of U.S. patent application Ser. No. 11/466,557, filed Aug. 23, 2006, which claims the benefit of Japanese Application No. 2005-249276 filed Aug. 30, 2005 and No. 2005-304258 filed Oct. 9, 2005, all of which are hereby incorporated by reference herein in their entirety.

BACKGROUND OF THE INVENTION

1. Field of the Invention

The present invention relates to a sheet feeding unit, a sheet feeding apparatus, and an image forming apparatus for one-by-one feeding sheets that tend to stick to each other.

2. Description of the Related Art

In image forming apparatuses such as photocopiers and printers, cut sheets of paper that can be continuously fed are normally limited to sheets of high-quality paper and normal paper designated by photocopier manufacturers. In order to separate and feed such sheets one-by-one, various frictional separation techniques, for example, a retard roller separation technique and a separation pad technique have been used.

The retard roller separation technique will be described. A pickup roller is in contact with the uppermost sheet of a stack of sheets. A feed roller is provided on the downstream side of the pickup roller in the sheet feeding direction. A separation roller is in contact with the feed roller and driven at a predetermined torque in the opposite direction from the sheet feeding direction. Of the sheets sent out by the pickup roller, only one sheet passes the nip between the feed roller and the separation roller. Thus, double feeding is prevented.

In the separation pad technique, a friction member is pressed against a feed roller at a predetermined pressure, and only one sheet passes through the nip therebetween. Thus, double feeding is prevented.

For example, in the case of the retard roller separation technique, sheets can be fed one by one, by appropriately setting the torque and pressure of the separation roller in consideration of the frictional force between the sheets.

In accordance with the diversification of recording media, there is an increasing demand to form an image on, for example, a sheet of very heavy paper, an overhead projector (OHP) sheet, and a sheet of art film. In addition, in accordance with a growing need for color printing, there is also an increasing demand to form an image on a sheet of coated paper having a surface coated to increase whiteness or glossiness.

However, in the case of sheets that are formed of a resin material that tends to be electrically charged, such as OHP sheets and sheets of art film, in a dry environment, the surfaces of the sheets are gradually charged due to friction therebetween during a feeding operation. Therefore, due to the Coulomb force, the sheets can stick to each other. Therefore, failure in pickup or double feeding can occur.

In the case of coated paper, under high humidity, the sheets can stick to each other. Therefore, in the conventional separation techniques, failure in pickup or double feeding can occur. This is because, in the conventional separating techniques, only the frictional force between sheets is considered.

In the case of the above special sheets, the frictional force between sheets is equal to or less than that of normal paper.

However, the adhesive force between resin sheets due to frictional charge in a dry environment and the adhesive force between sheets of coated paper under high humidity are much higher than the frictional force between the sheets. Therefore, in the conventional separation techniques, such special sheets can fail to be separated.

To eliminate the above-described strong adhesion between sheets, there is proposed a sheet feeding apparatus having an auxiliary air adhesion eliminating device that blows air against a stack of sheets from the side. This apparatus blows air against a stack of sheets from the side, thereby eliminating adhesion between the sheets in advance. After the adhesion between the sheets is eliminated, a pickup roller sends out the sheets. A separating section provided on the downstream side of the pickup roller separates one sheet from the other. This apparatus is used in the print industry and some photocopiers.

Unlike generally used apparatuses that use only the frictional separation technique, the feeding apparatus having an auxiliary air adhesion eliminating device can separate even the above highly adhesive sheets because it eliminates adhesion before feeding. Concerning such a feeding technique using an auxiliary air adhesion eliminating device, many proposals have been made, for example, Japanese Patent Laid-Open No. 11-005643 (corresponding to U.S. Pat. No. 6,015,144).

FIG. 16 shows an example of a sheet feeding apparatus 155 having an auxiliary air adhesion eliminating device. This sheet feeding apparatus 155 includes a feed tray 156 in which sheets S are loaded, and a sheet feeding device (not shown) that sends out sheets from the feed tray 156. The sheet feeding apparatus 155 further includes an air blowing device 71 serving as an auxiliary air adhesion eliminating device. The air blowing device 71 blows air against the side and over the top of the stack of sheets from the direction perpendicular to the side surface of the stack.

The sheet feeding apparatus 155 further includes an airflow moving device 157, which includes an electric motor 121 and cam plates 123. The motor 121 rotates the cam plates 123 so as to vertically move the air blowing device 71. Thus, the airflow is vertically moved.

Japanese Patent Laid-Open No. 2001-48366 discloses an apparatus including an auxiliary hot-air adhesion eliminating device capable of drying sheets by blowing air heated with a heater. This can weaken the adhesive force particularly between sheets of coated paper under high humidity.

However, the above sheet feeding apparatus using an auxiliary air adhesion eliminating device or an auxiliary hot-air adhesion eliminating device requires devices such as an air blowing device, a heater device, and an electric motor. Therefore, such a sheet feeding apparatus has been used in a relatively large feeding deck whose capacity is 2000 to 4000 sheets. Therefore, when being applied to apparatuses such as a photocopier, the feeding apparatus can be applied only to high-speed and high-class models to which a large feeding deck can be attached.

Therefore, the feeding apparatus cannot be applied to relatively low and medium class models to which a large feeding deck cannot be attached, and models for office use whose installation space is limited. If such models use highly adhesive sheets, the sheets can fail to be separated and double feeding can occur.

SUMMARY OF THE INVENTION

The present invention is directed to a sheet feeding apparatus that makes it possible to apply the air adhesion elimination to, for example, image forming apparatuses for office use.

In an aspect of the present invention, a sheet feeding apparatus for feeding sheets includes a sheet cassette and a sheet feeding unit. Sheets are loaded in the sheet cassette. The sheet feeding assisting unit is detachably attached to the sheet cassette and includes an air blowing mechanism operable to blow air against the edges of sheets to be fed.

In another aspect of the present invention, an image forming apparatus that forms an image on a sheet includes a sheet cassette, a sheet feeding assisting unit, a sheet feeding member, and an image forming section. Sheets are loaded in the sheet cassette. The sheet feeding assisting unit is detachably attached to the sheet cassette and includes an air blowing mechanism operable to blow air against the edges of sheets to be fed. The sheet feeding member feeds the sheets loaded in the sheet cassette. The image forming section is configured to form an image on a sheet fed by the sheet feeding member.

Further features of the present invention will become apparent from the following description of exemplary embodiments (with reference to the attached drawings).

DESCRIPTION OF THE EMBODIMENTS

The embodiments of the present invention will now be described with reference to the drawings.

Image Forming Apparatus

Figure 1:
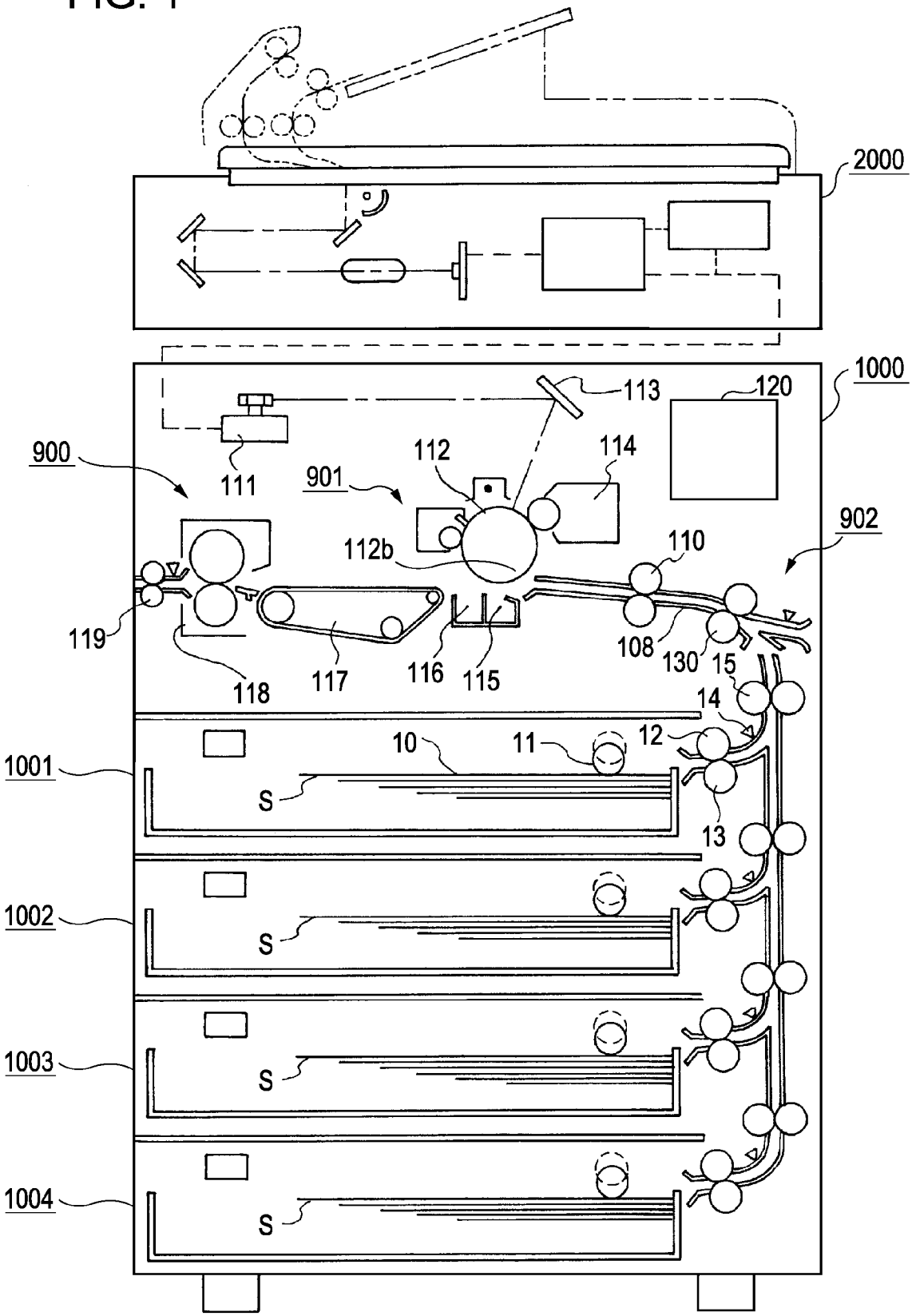
FIG. 1 is a sectional view of a printer that is an example of an image forming apparatus having a sheet feeding apparatus according to a first embodiment of the present invention.

FIG. 1 is a sectional view of an image forming apparatus to which a sheet feeding apparatus according to a first embodiment is attached.

First, the overall structure of the image forming apparatus will be described. Reference numeral 900 denotes the image forming apparatus of this embodiment. In the upper part of the apparatus body, a scanner section 2000 is disposed. The scanner section 2000 optically reads the document information.

In the lower part of the apparatus body, four sheet feeding apparatuses 1001 to 1004 are disposed. The apparatuses 1001 to 1004 feed sheets to an image forming section 901. The image forming apparatus 900 further includes a sheet conveying apparatus 902 and a controller 120. Sheets S sent out from the sheet feeding apparatuses 1001 to 1004 are conveyed to the image forming section 901 by the sheet conveying apparatus 902. The controller 120 controls the image forming apparatus 900.

The sheet conveying apparatus 902 includes a conveying roller pair 15, a preliminary register roller pair 130, a register roller pair 110, and a sheet conveying path 108 composed of guide plates. A sheet S sent out from one of the sheet feeding apparatuses 1001 to 1004 is caused to pass along the sheet conveying path 108 by the conveying roller pair 15, and is then guided to the register roller pair 110. Next, the sheet S is conveyed to the image forming section 901 by the register roller pair 110.

The image forming section 901 includes a photosensitive drum 112, a laser scanner 111, a developer 114, a transfer charger 115, and a separation charger 116. When an image is formed, laser light from the laser scanner 111 is reflected by a mirror 113 onto the photosensitive drum 112, which rotates clockwise, and a latent image is thereby formed on the photosensitive drum 112. The latent image formed on the photosensitive drum 112 is then converted into a visible toner image by the developer 114.

The toner image on the photosensitive drum 112 is then transferred onto the sheet S by the transfer charger 115 in a transferring section 112*b*. The sheet S with the transferred toner image thereon is separated from the photosensitive drum 112 by the separation charger 116, and is then conveyed by a conveying belt 117 to a fixing device 118, in which the toner image is fixed. Next, the sheet S is discharged by a discharging roller pair 119 onto a discharged paper tray or into an after-treatment device (both not shown).

The image forming apparatus 900 of this embodiment has four sheet feeding apparatuses 1001 to 1004 that feed sheets to the image forming section 901. The four sheet feeding apparatuses 1001 to 1004 have the same structure. Therefore, only the sheet feeding apparatus 1001 will be described.

First Exemplary Embodiment

As shown in FIG. 1, the sheet feeding apparatus 1001 of the first embodiment includes a pickup roller 11 and a separating section. The pickup roller 11 serves as a sheet feeding member that feeds sheets S loaded in a sheet cassette 10. The separating section includes a feed roller 12 and a retard roller 13 that rotates in the opposite direction from the feed roller 12. The pickup roller 11 moves up and down and rotates at a predetermined time. The sheets S in the sheet cassette 10 are separated and fed one at a time by the pickup roller 11 and the separating section. A feed sensor 14 is provided on the downstream side and in the vicinity of the feed roller 12 and the retard roller 13. This feed sensor 14 can detect the passage of the sheet S.

The sheet cassette 10 is detachably attached to the sheet feeding apparatus 1001. When sheets that are hard to separate are used, a hereinafter-described sheet feeding unit is attached to the sheet cassette 10, and the sheets are loaded in the sheet feeding unit. However, when normal paper is used, the sheet feeding unit is not attached to the sheet cassette 10, and the sheets are loaded in the sheet cassette 10.

Figure 2:
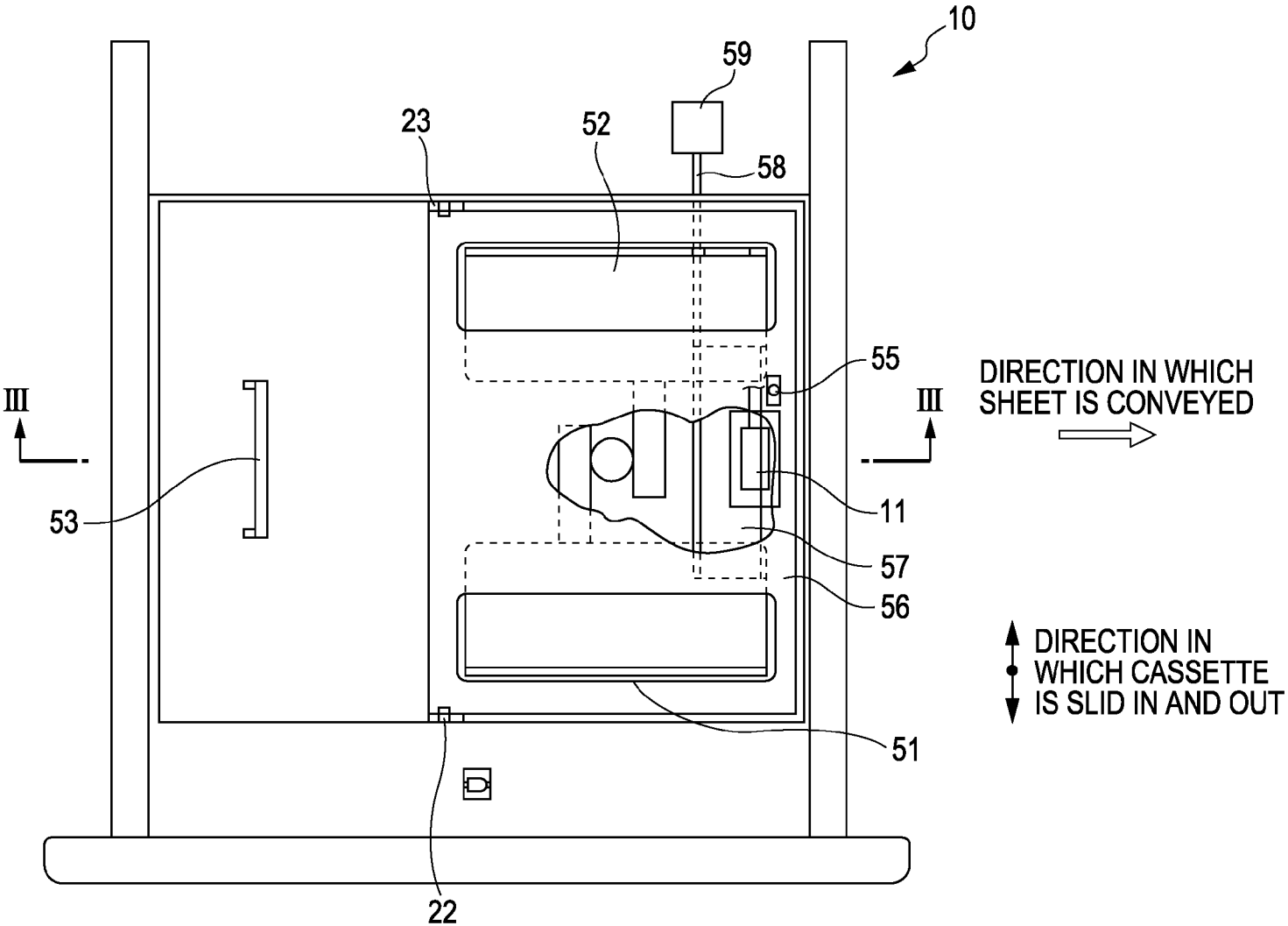
FIG. 2 is a plan view showing the structure of the sheet cassette shown in FIG. 1.
Figure 3:
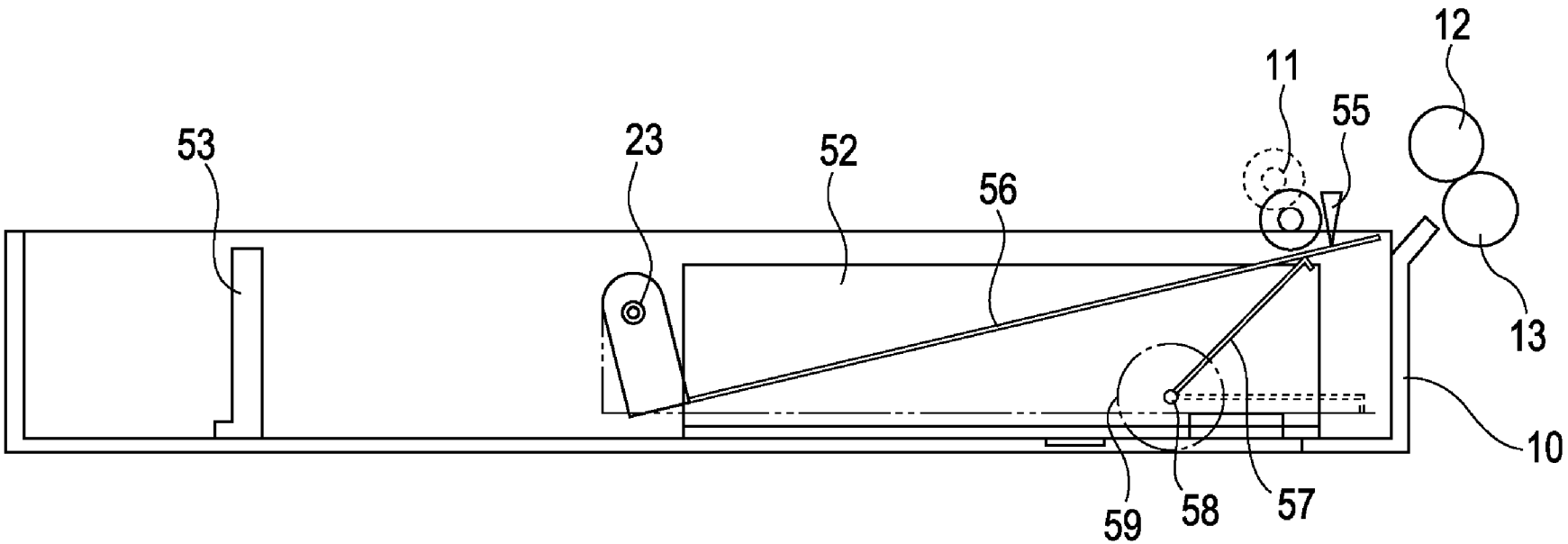
FIG. 3 is a sectional view of the sheet cassette shown in FIG. 1.

First, the sheet cassette 10 will be described with reference to FIGS. 2 and 3. FIG. 2 is a plan view showing the structure of the sheet cassette 10, and FIG. 3 is a sectional view thereof. Cassette chambers are provided in the image forming apparatus 900. In this embodiment, the sheet cassette 10 can be slid in and out of one of the cassette chambers in the width direction perpendicular to the sheet feeding direction (perpendicularly to the drawing plane in FIG. 1).

In FIG. 2, reference numerals 51 and 52 denote side positioning plates, which serve as sheet positioning devices that position the ends of the sheets loaded in the sheet cassette 10 in the width direction (the direction perpendicular to the sheet feeding direction). These side positioning plates 51 and 52 are movable in the width direction according to the size of the sheets S. Reference numeral 53 denote a rear positioning plate, which serving as a sheet restricting device that positions the rear end of the sheets S in the sheet feeding direction. This rear positioning plate 53 is movable in the sheet feeding direction according to the size of the sheets S.

The sheet cassette 10 can be pulled out along cassette rails (not shown). When a user loads sheets S, the sheet cassette 10 can be pulled out of the image forming apparatus. When the sheet cassette 10 has been loaded in the cassette chamber, a cassette sensor (not shown) detects the sheet cassette 10. The cassette sensor sends a detection signal to the controller 120. On the basis of the detection signal from the cassette sensor, the controller 120 can detect whether the sheet cassette 10 is loaded in the sheet feeding apparatus 1001 (see FIG. 1) or pulled out.

As shown in FIG. 3, a cassette tray 56 for loading sheets S is provided in the sheet cassette 10. The cassette tray 56 is pivotably supported by supporting pins 22 and 23. Under the cassette tray 56, a lifter mechanism is disposed. The lifter mechanism raises and lowers the cassette tray 56. The lifter mechanism includes a lifter plate 57, which is in contact with the cassette tray 56 and lifts it. The lifter plate 57 is attached to a lifter drive shaft 58 and is pivotable by the driving force input from a lifter drive gear 59.

When the sheet cassette 10 is loaded in the body, a driving source (not shown) transmits driving force to the driving gear 59, and the lifter plate 57 thereby causes the cassette tray 56 to pivot. That is to say, the lifter plate 57 presses up the cassette tray 56 according to whether or not the sheet cassette 10 is loaded.

A sheet surface position sensor 55 is provided above the sheet cassette 10. When the sheet cassette 10 is loaded in the apparatus body, the sensor 55 detects whether or not the top surface of a stack of sheets loaded in the cassette tray 56 is at a feedable position. Driving force is transmitted to the driving gear 59 so that the top surface of the stack of sheets loaded in the cassette tray 56 keeps at an appropriate position.

With the feeding of the sheets, the sheets S are sequentially sent out from the top, and the top surface of the stack of sheets gradually lowers. When the sheet surface position sensor 55 is turned OFF, the controller 120 drives the lifter motor so that the cassette tray 56 rises. In this way, the level of the top surface of the stack of sheets can be kept within a certain range. This is the structure of the sheet cassette 10 in the case where normal paper is used.

Next, the case where sheets that a normal sheet cassette 10 tends to double-feed, such as heavy paper and coated paper, are used will be described with reference to FIGS. 4 to 8.

When such sheets are used, in this embodiment, a sheet feeding assisting unit is installed in the sheet cassette 10, and the sheets are loaded in this sheet feeding unit. Next, the sheet cassette 10 is loaded in the image forming apparatus body, and the sheets are fed from the sheet feeding assisting unit.

Figure 4:
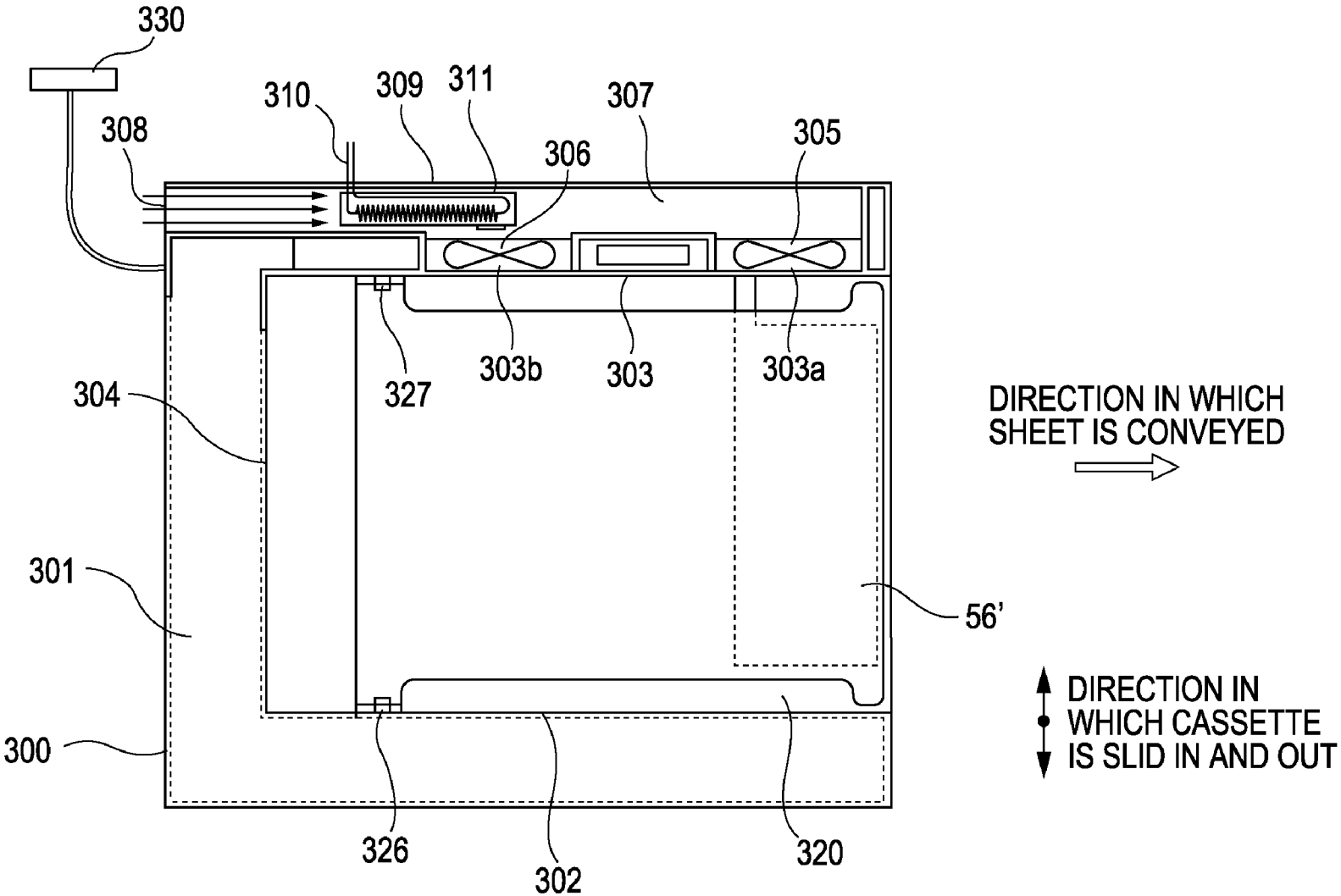
FIG. 4 is a plan view of a sheet feeding unit to be installed in the sheet cassette.

FIG. 4 is a plan view showing the structure of a sheet feeding assisting unit 300 for feeding special sheets difficult to separate, such as heavy paper and coated paper.

The sheet feeding assisting unit 300 has a case 301. The case 301 has inner walls 302 and 303 in the width direction of the sheets and an inner wall 304 at the rear end in the feeding direction. The inner walls 302, 303, and 304 form a sheet loading space 320 whose shape and size are set according to the size of paper, such as A4 and B4.

In the sheet loading space 320, a sheet tray 56' is pivotably supported by supporters 326 and 327.

In order to blow air between sheets sticking to each other, a plurality of (two in this embodiment) blowing ports (openings) 303*a* and 303*b* are provided along the back inner wall 303 in the sheet width direction at predetermined intervals. The blowing ports 303*a* and 303*b* face at least the side of the sheet S located at the feedable position. The blowing ports 303*a* and 303*b* communicate with a duct 307. In the duct 307, fans 305 and 306 are provided. The fans 305 and 306 serve as air blowing mechanisms. The fans 305 and 306 blow air against the side surface of the stack of sheets loaded in the sheet loading space 320 through the blowing ports 303*a* and 303*b*.

In the vicinity of an air intake 308 of the duct 307, an air heating mechanism 309 is provided. The air heating mechanism 309 includes a heater 310 and a heat sink 311. Air taken in through the air intake 308 is heated by the air heating mechanism 309 and then blown out through the vents 303*a* and 303*b*.

Figure 5:
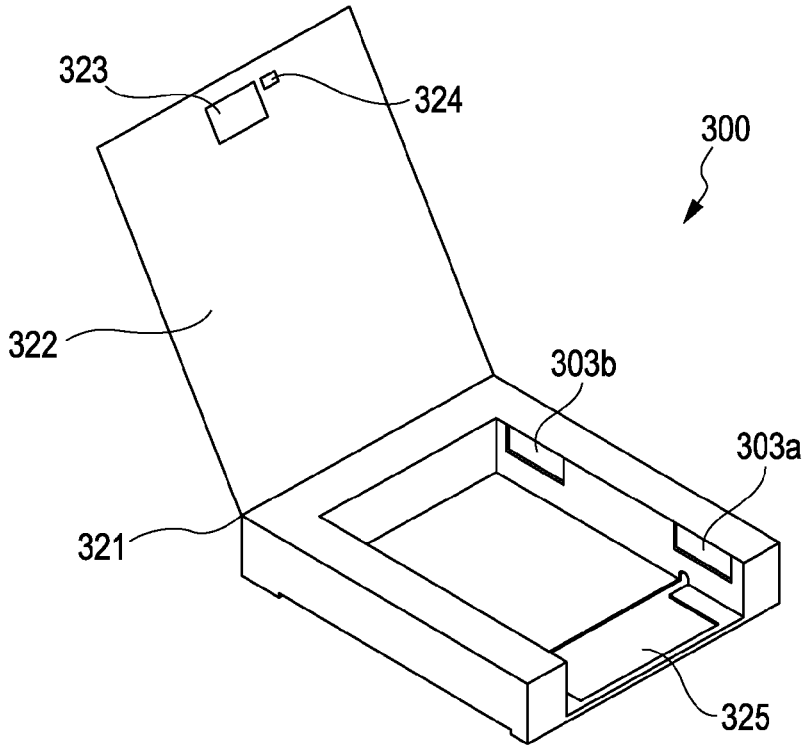
FIG. 5 is a perspective view of the sheet feeding unit with the top lid open.
Figure 6:
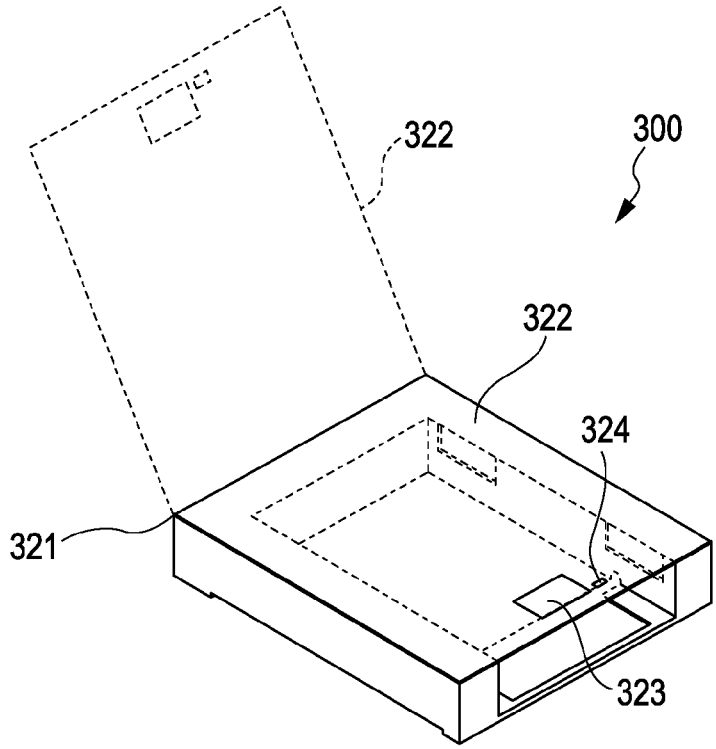
FIG. 6 is a perspective view of the sheet feeding unit with the top lid closed.
Figure 7:
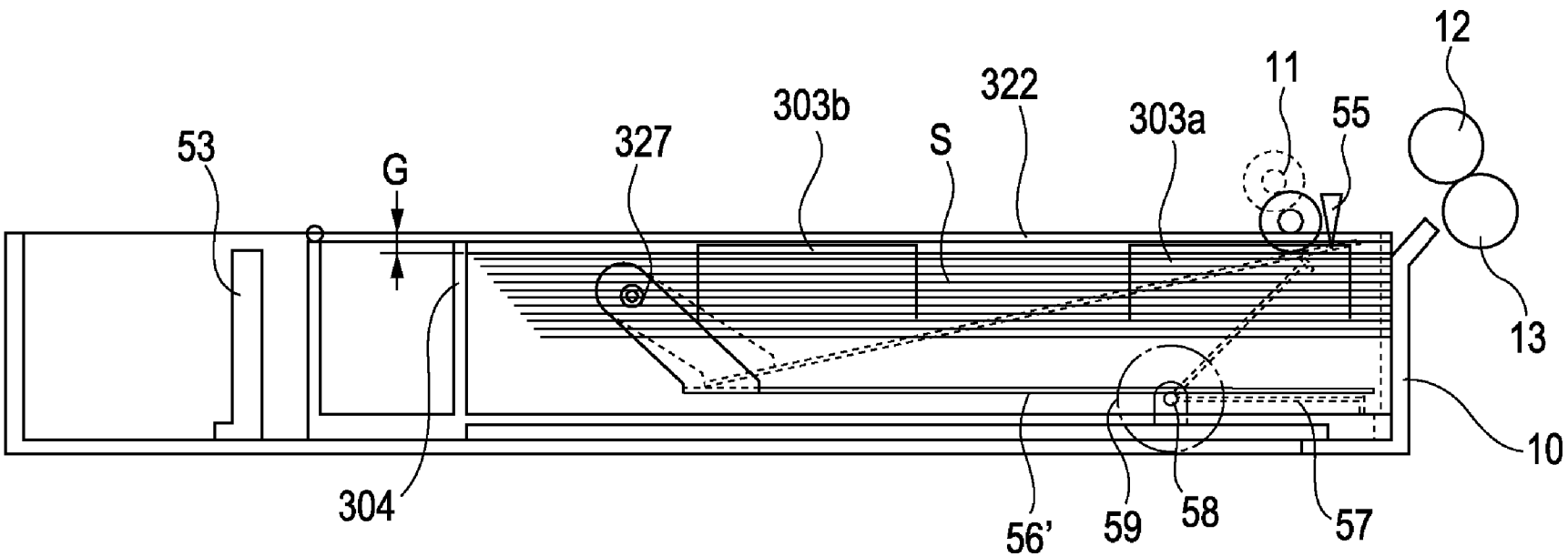
FIG. 7 is a sectional view of the sheet cassette installed with the sheet feeding unit.

As shown in FIGS. 5 to 7, the sheet feeding assisting unit 300 of this embodiment is provided with a top lid (openable cover) 322. The top lid 322 covers the sheet loading space 320 and openable by a hinge 321. When the top lid 322 is closed, a predetermined distance G is set between the top lid 322 and the uppermost sheet. The top lid 322 is provided with holes 323 and 324 so as not to be interfered with by the pickup roller 11 and the sheet surface position sensor 55, respectively. Therefore, the closed top lid 322 does not interfere with the sheet feeding.

If air lifts up the top lid 322 and leaks from the sheet loading space 320, the sheet separation is hindered. In order to prevent this, when the top lid 322 is closed, the top lid 322 is locked by a locking device (not shown). In order to prevent air leakage, the top lid 322 may be fastened to the case 301 using Velcro (hook and loop fastener) or a sealing member such as Moltopren.

In the bottom of the sheet loading space 320 of the sheet feeding assisting unit 300, a hole 325 for passing the lifter plate 57 is formed. The lifter plate 57 passes through the hole 325 to be in contact with the sheet tray 56'.

Figure 8:
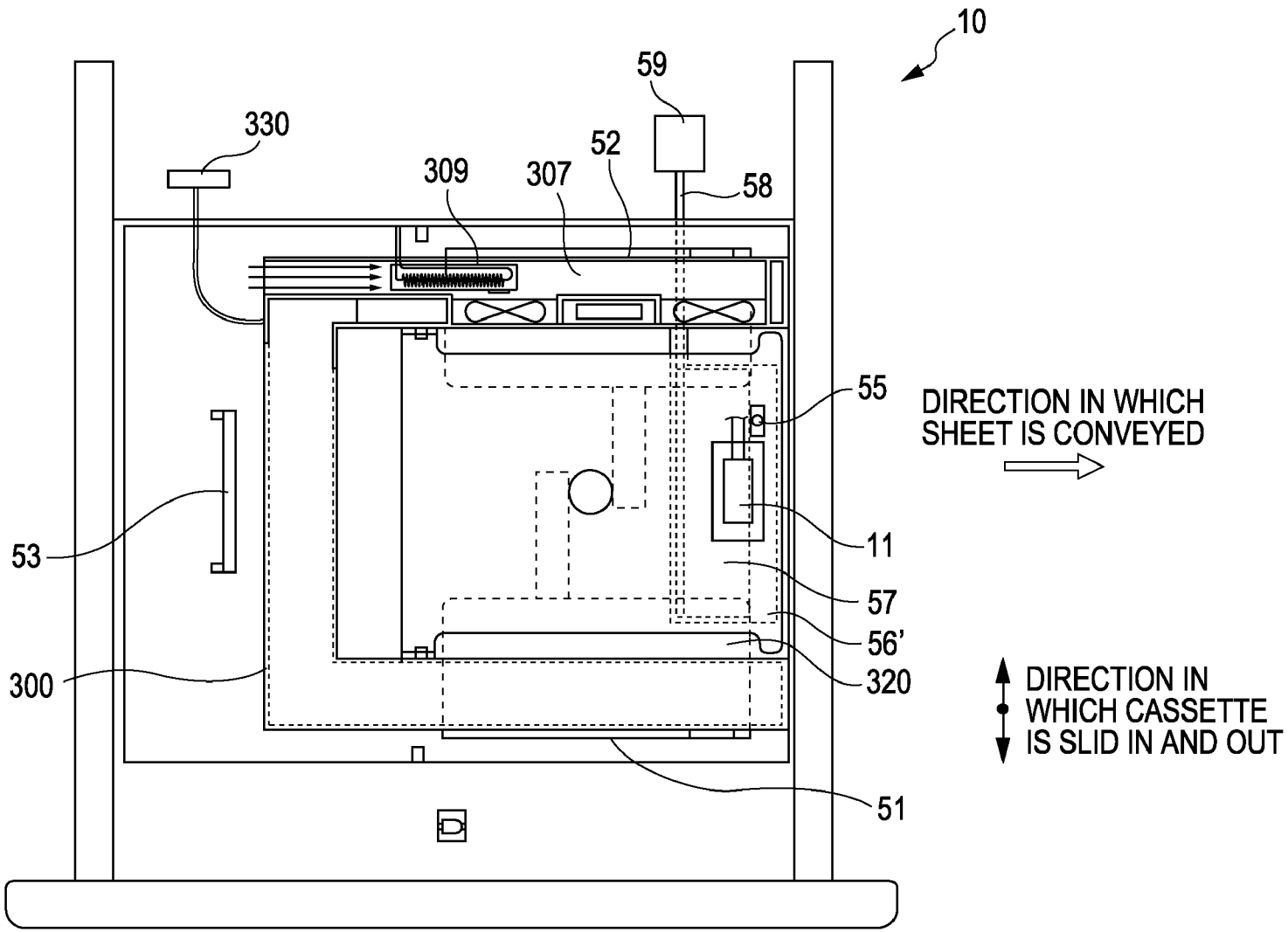
FIG. 8 is a plan view of the sheet cassette installed with the sheet feeding unit.

Next, the procedure to load sheets of a predetermined size into the sheet loading space 320 of the sheet feeding assisting unit 300 and to install the sheet feeding assisting unit 300, with the top lid 322 closed, in the sheet cassette 10 will be described with reference to FIG. 8.

First, the cassette tray 56 is detached from the sheet cassette 10. As shown in FIGS. 2 and 3, the cassette tray 56 is pivotably attached to the inner wall of the sheet cassette 10 with the supporting pins 22 and 23. Therefore, the cassette tray 56 can be easily detached by removing the supporting pins 22 and 23. The supporting pins 22 and 23 may be molded of plastic integrally with the case. In this case, the cassette tray 56 is detached by elastically deforming the plastic.

Next, the rear positioning plate 53 and the side restricting plates 51 and 52 are moved so that the sheet feeding assisting unit 300 can be inserted. Next, as shown in FIG. 8, the sheet feeding assisting unit 300 is placed at a predetermined position in the sheet cassette 10. At this time, the side positioning plates 51 and 52 and the rear positioning plate 53 may be pressed against the outer wall of the sheet feeding assisting unit 300 so as to position the sheet feeding assisting unit 300 in the sheet cassette 10.

Alternatively, the side positioning plates 51 and 52 and the rear positioning plate 53 may de detachable. In this case, after the positioning plates are detached, the sheet feeding assisting unit 300 is fitted into the sheet cassette 10.

Finally, a connector 330 for sending and receiving electrical signals and control signals is coupled to a connecting cable (not shown) in the cassette chamber of the image forming apparatus 900. The connecting cable is, for example, a flexible cable that maintains electrical connection even when the sheet cassette 10 is fully pulled out. Alternatively, electrical connection can be performed only when the sheet cassette 10 is loaded in the image forming apparatus body, using a drawer connector.

The lifting operation after the sheet cassette 10 is loaded in the image forming apparatus body is the same as that when normal paper is used. The lifter plate 57 comes into contact with the sheet tray 56' and causes the sheet tray 56' to pivot. By the detection of the sheet surface position sensor 55, the position of the uppermost sheet is maintained substantially constant. At this time, the same lifter control as in the case where the sheet feeding assisting unit is not installed in the sheet cassette 10 is possible.

Adhesion Eliminating Operation

Next, the adhesion eliminating operation when the sheet feeding assisting unit 300 is installed in the sheet cassette 10 will be described with reference to FIG. 8. As described above, air is blown out through the blowing ports 303*a* and 303*b* formed in the inner wall 303 so as to eliminate adhesion between the sheets. At this time, in this embodiment, the sheet loading space 320 of the sheet feeding assisting unit 300 is covered by the top lid 322. Therefore, the sheet loading space 320 is hermetically closed, and the efficiency of adhesive elimination by the blowing of the fans 305 and 306 is dramatically improved. In addition, the efficiency of air heating by the heater 310 is also improved.

That is to say, since the sheet loading space 320 is covered by the top lid 322, the sheet loading space 320 is a hermetically closed space having substantially the same volume as the sheets loaded therein. Therefore, air blows against the side surface of the stack of sheets substantially perpendicularly. In addition, if the air flow by the fans 305 and 306 is not strong, the air flows straight. Therefore, the efficiency of adhesion elimination is improved. Therefore, the size of the fans 305 and 306 can be reduced. In addition, the driving current can also be reduced. Therefore, the size of the apparatus can be reduced.

A predetermined distance G is set between the top lid 322 and the uppermost sheet so that the sheet feeding and the adhesion elimination can be smoothly performed. The distance G can be about 2 mm to 20 mm. If the distance G is smaller than 2 mm, the separation of sheets due to the levitation of sheets due to the blowing of air is imperfect. If the distance G is larger than 20 mm, when air is blown, the effect of enclosed space decreases.

In addition, in the case where the heater 310 is driven to blow hot air, even if the environment is highly humid or wet sheets are used, the sheet drying efficiency is much higher than that of a large feeding deck such as the above-described known example.

In addition, since a limited and enclosed sheet loading space can be formed, it is possible to reduce the size of the fans, heater, and so on, and to provide an apparatus that uses less power, is compact, and energy-efficient.

In addition, a sheet cassette 10 in which the sheet feeding assisting unit 300 of this embodiment is installed can be loaded in any cassette chamber, if necessary. For example, in the case of this embodiment, only one cassette chamber may be loaded with such sheet cassette. Alternatively, all four cassette chambers may be loaded with such sheet cassettes. Moreover, if the sheet feeding assisting unit 300 becomes unnecessary, it can easily be removed so as to return the sheet cassette to its normal state. Such a user-friendly apparatus can be provided.

Figure 9:
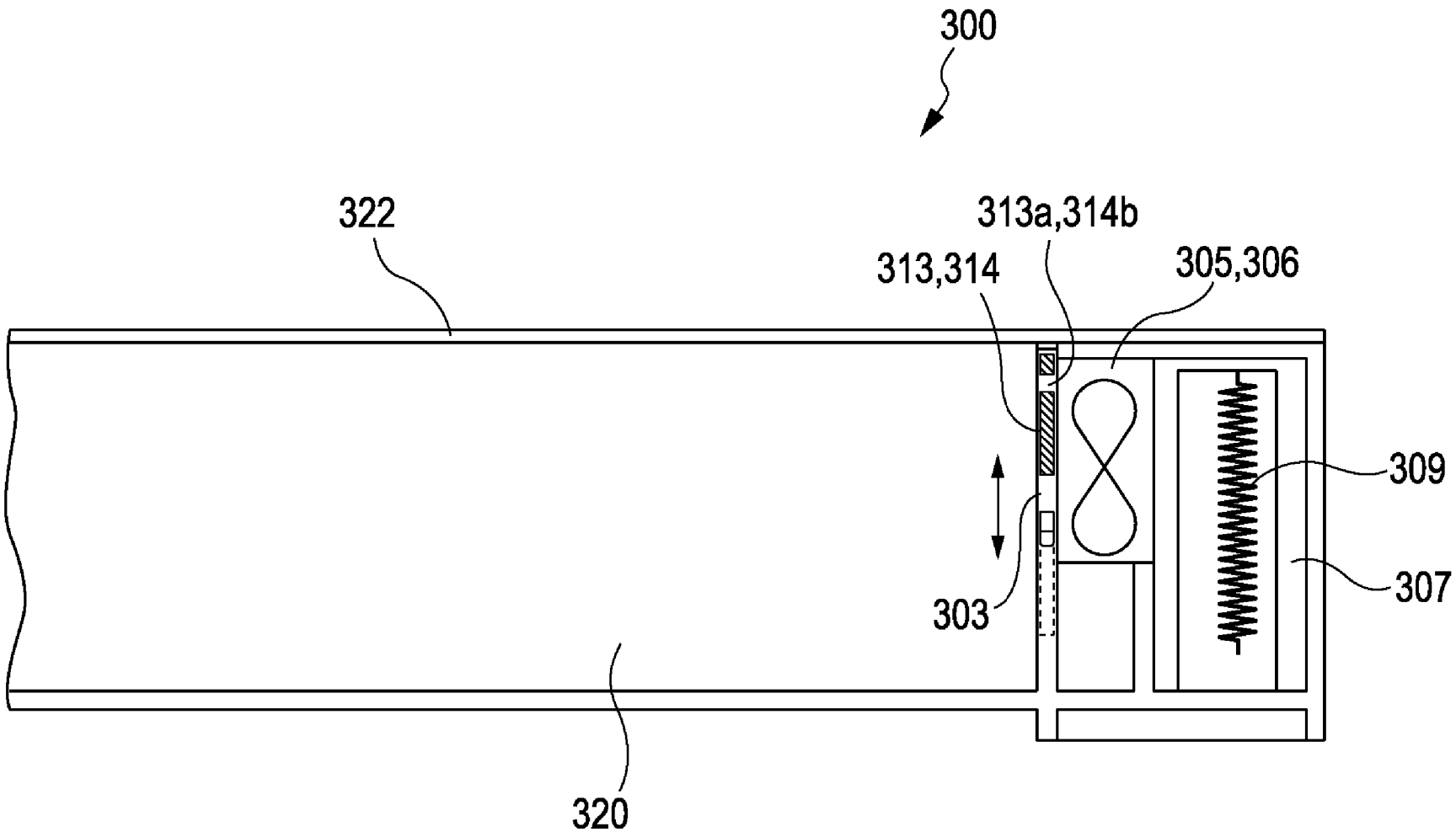
FIG. 9 shows a section of the sheet feeding unit viewed from the right side.

As shown in FIG. 9, the blowing ports 303*a* and 303*b* may be respectively provided with shutters 313 and 314 capable of moving up and down in the arrow direction. The shutters 313 and 314 serve as air swinging devices and have openings 313*a* and 314*b* through which air passes. FIG. 9 partly shows a section of the sheet feeding assisting unit 300 of this embodiment viewed from the right side. The shutters 313 and 314 can be moved up and down by a driving source and a driving mechanism (both not shown).

When air is blown against the stack of sheets S, the openings 313*a* and 314*b* vertically move with the vertical motion of the shutters 313 and 314, thereby vertically swing the blowing air. Thus, air is sequentially blown into between the sheets, and the efficiency of adhesion elimination is further improved.

Second Exemplary Embodiment

In the first embodiment, air is taken in through the air intake 308 of the sheet feeding assisting unit 300 and is blown against the side surface of the stack of sheets in the sheet loading space 320 through the blowing ports 303*a* and 303*b*. However, the air blown out through the blowing ports 303*a* and 303*b* may be circulated in the sheet feeding assisting unit 300. In the description of the sheet feeding apparatus of the second embodiment, only the differences from the first embodiment will be described in detail, and the description of components in common with the first embodiment will be omitted.

Figure 10:
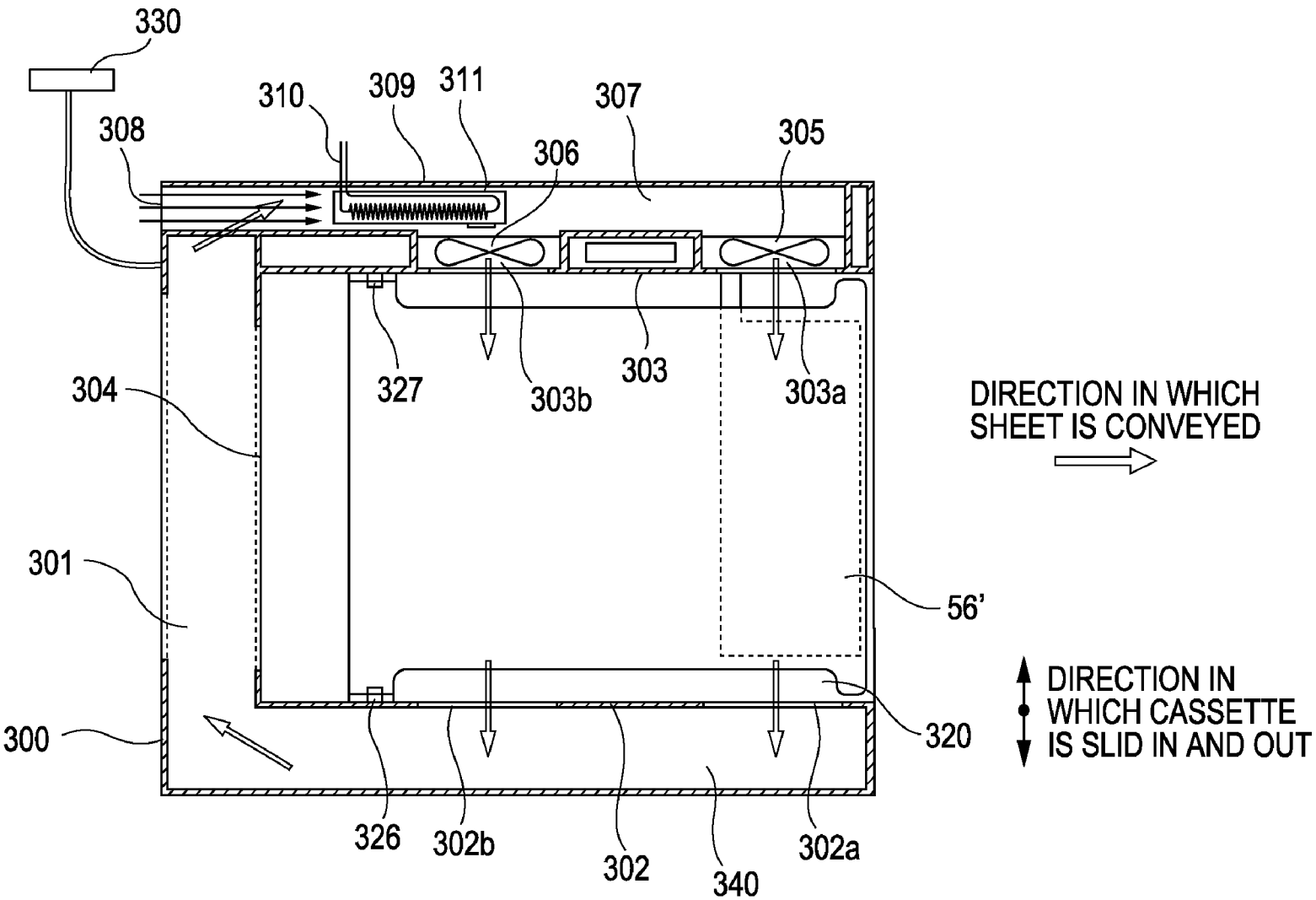
FIG. 10 is a plan view of a sheet feeding unit according to a second embodiment.

As shown in FIG. 10, the inner wall 302 opposite the blowing ports 303*a* and 303*b* is provided with exhaust ports 302*a* and 302*b*, and the case 301 is provided with a circulation duct 340 in which air circulates. The air heated by the air heating mechanism 309 passes through the circulation duct 340 as shown by arrows and is repeatedly supplied to the sheet loading space 320. Therefore, the air heating efficiency is improved. Therefore, the power consumption of the heater 310 can be reduced. During a continuous run, the heater 310 can be turned OFF. In this case, the size of the air intake 308 can be reduced, if necessary. In addition, if air is completely circulated in the case, the air intake 308 is not necessary.

In the first embodiment, the heater 310 is provided in the duct. However, the heater can be provided elsewhere as long as it can heat the air blowing against the sheets.

Figure 11:
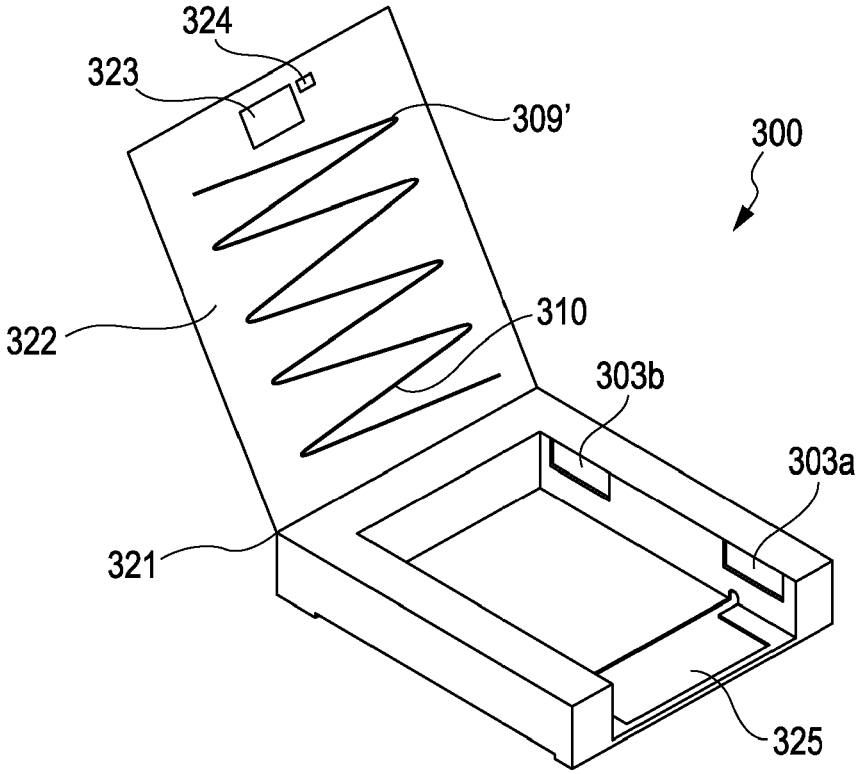
FIG. 11 is a perspective view of a sheet feeding unit whose top lid is provided with an air heating device.

For example, as shown in FIG. 11, an air heating mechanism 309' including a heater 310 can be provided in the top lid 322. This configuration makes it possible to heat the air and sheets in the sheet loading space 320 from above. This makes it possible to dry the sheets and ensures the sheet separation by air.

As described above, when the heater 310 is provided in the top lid 322, it is not necessary to provide a heater in the duct 307. Therefore, space can be saved in the sheet width direction of the sheet feeding assisting unit 300. Therefore, wider sheets can be loaded.

In addition, in the first embodiment, the size of the sheet loading space 320 of the sheet feeding assisting unit 300 is fixed, and therefore the size of loadable sheets is also fixed. However, the size of loadable sheets can be made selectable by making the inner walls of the case 301 movable.

In this case, the fans 305 and 306 are moved together with the inner wall 303 so as to maintain the distance to the side surface of the stack of sheets, in terms of the efficiency of adhesive elimination by air.

Alternatively, instead of movable inner walls, side positioning plates that position both sides of the sheets and a rear positioning plate that positions the rear end of the sheets may be slidably provided in the sheet loading space 320. In this case, the size of the sheet loading space 320 is set to the maximum size of loadable sheets.

In the first embodiment, since the top lid 322 is provided, the sheet loading space 320 is hermetically closed, and the efficiency of adhesion elimination by air blowing is improved. However, if the air blowing by the fans 305 and 306 is sufficiently strong, the sheet loading space 320 is not necessarily closed by the top lid 322. In this case, compared to the case where the top lid 322 is provided, the size of the fans 305 and 306 is inevitably large but the number of parts is small because the top lid 322 is not provided.

In the first embodiment, the blowing ports 303*a* and 303*b* are provided in the inner wall 303 at the back of the apparatus (on the left side in the sheet feeding direction). However, of course, the blowing ports 303*a* and 303*b* can be provided in the inner wall 302 at the front of the apparatus (on the right side in the sheet feeding direction). Alternatively, both inner walls 302 and 303 can be provided with blowing ports.

In the first embodiment, the sheet tray 56' of the sheet feeding assisting unit 300 is raised and lowered by the lifter plate 57 provided in the sheet cassette 10. However, the cassette tray 56 may be pressed up by an urging device such as a spring provided in the sheet cassette 10. In this case, when the sheet feeding assisting unit 300 is installed in the sheet cassette 10, the sheet tray 56' is pressed up by the urging device.

In addition, in the sheet feeding apparatus of the first embodiment, a retard roller separation technique is used for separating the sheets. However, the technique for separating sheets is not limited to this. Any other technique, for example, a separation pad technique can be used.

Third Exemplary Embodiment

Next, a third embodiment will be described with reference to FIGS. 12 to 15. In the description of the sheet feeding apparatus of the third embodiment, only the differences from the first embodiment will be described in detail, and the description of components in common with the first embodiment will be omitted.

Figure 12:
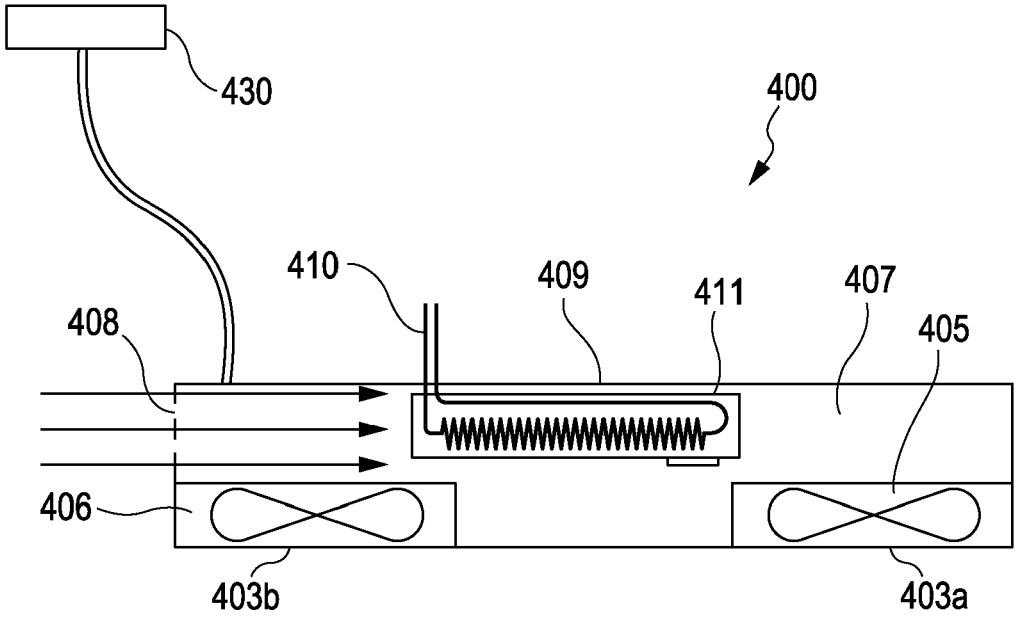
FIG. 12 is a plan view of an air blowing apparatus according to a third embodiment.
Figure 13:
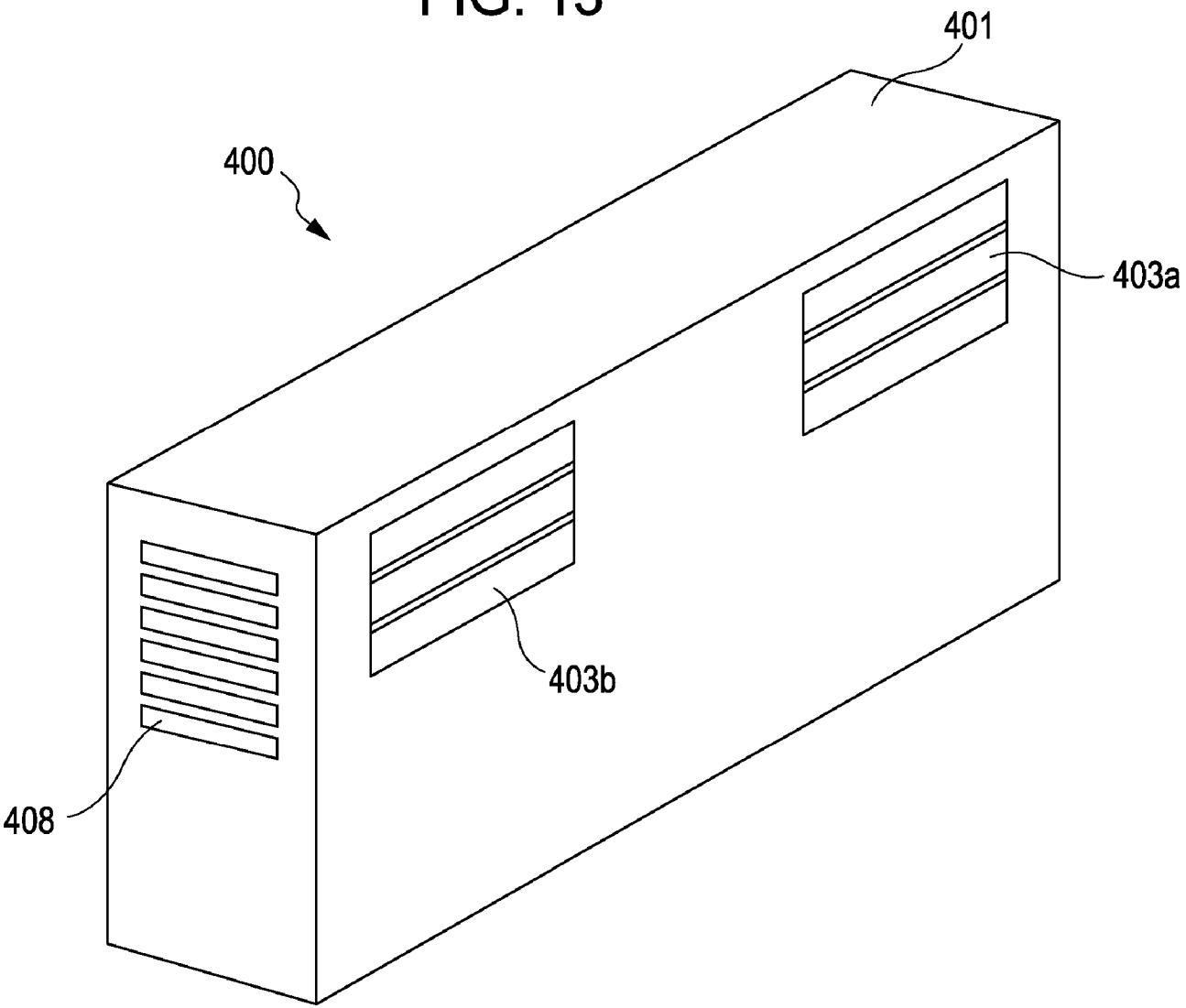
FIG. 13 is a perspective view of the air blowing apparatus shown in FIG. 12.
Figure 14:
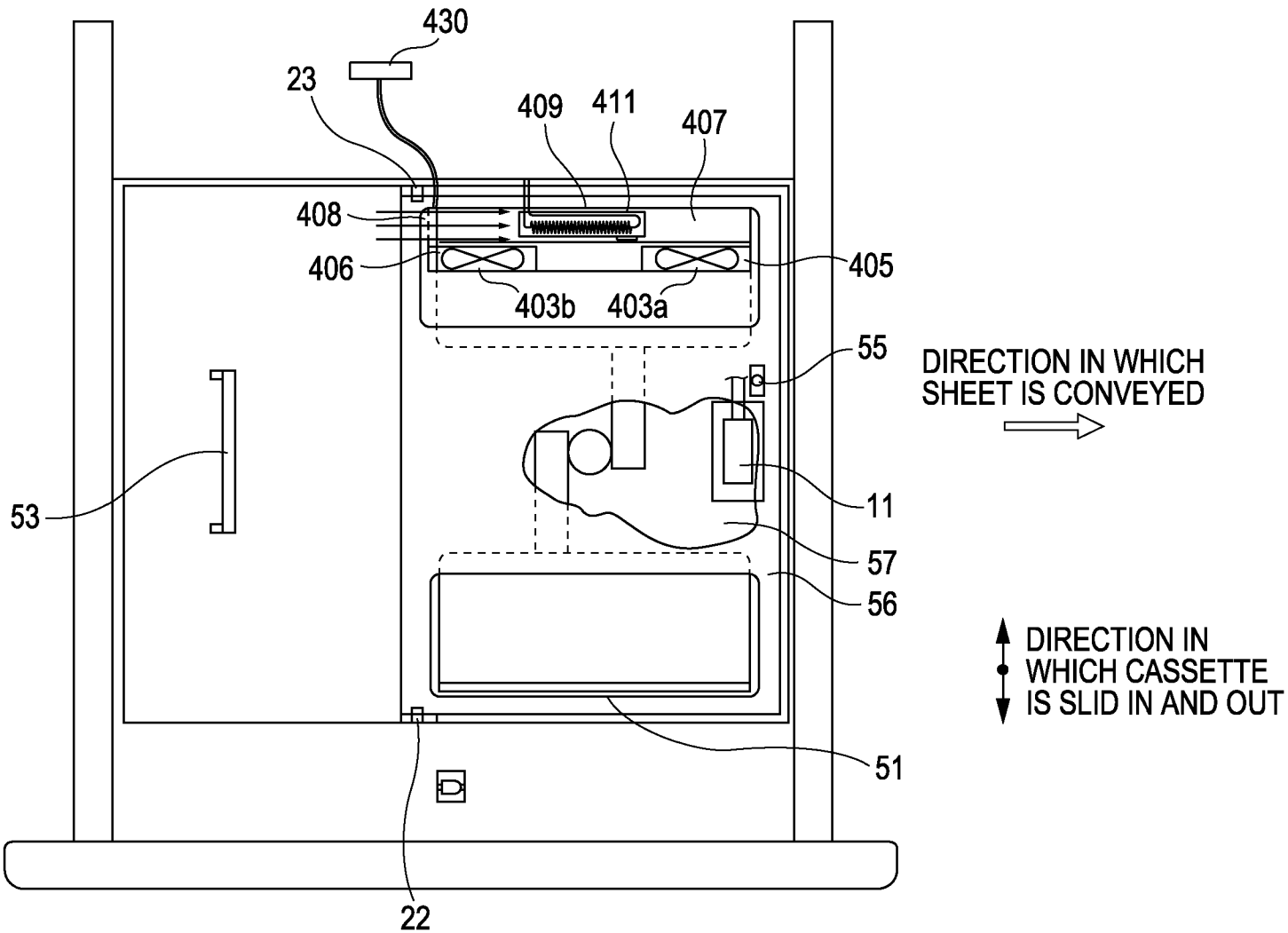
FIG. 14 is a plan view of a sheet cassette installed with the air blowing apparatus.
Figure 15:
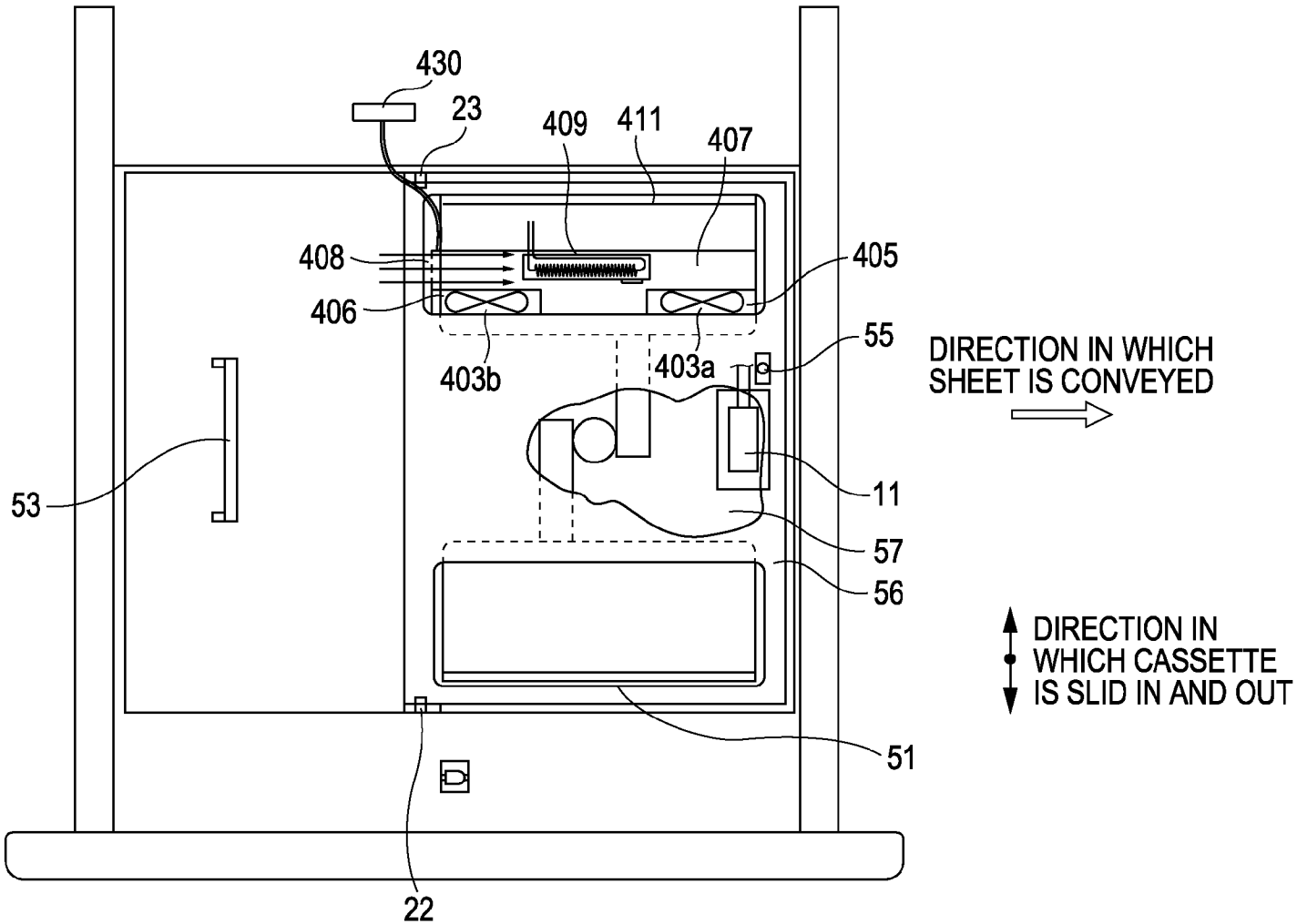
FIG. 15 is a plan view of a sheet cassette installed with the air blowing apparatus.
Figure 16:
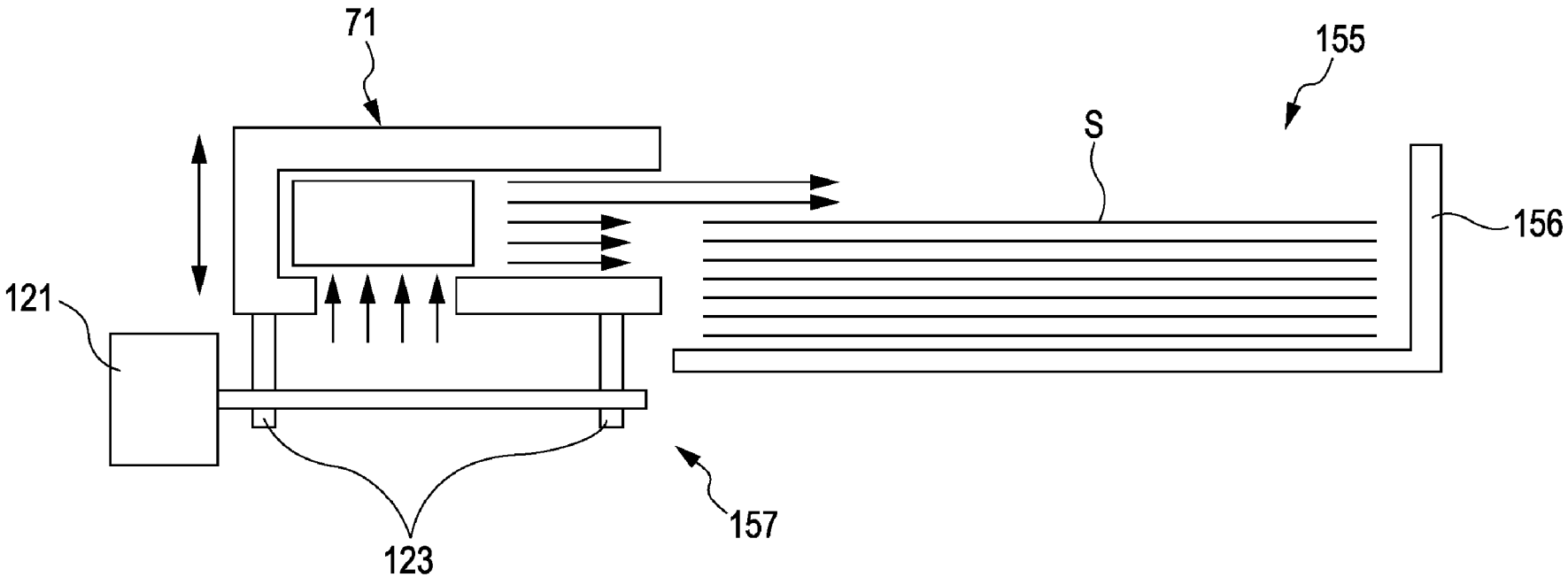
FIG. 16 PRIOR ART
FIG. 16 is an explanatory view of a conventional sheet feeding apparatus.

FIG. 12 is a horizontal sectional view showing the structure of a sheet feeding assisting unit 400 for feeding sheets difficult to separate, such as heavy paper and coated paper. FIG. 13 is a perspective view of the sheet feeding assisting unit 400. FIGS. 14 and 15 are plan views showing a sheet cassette 10 in which the sheet feeding assisting unit 400 is installed.

The case 401 of the sheet feeding assisting unit 400 is rectangular-parallelepiped-shaped and is a size such that it can be installed in the sheet cassette. The sheet feeding assisting unit 400 has an air intake 408, a heater 409, a duct 407, fans 405 and 406, and blowing ports 403*a* and 403*b*. The air intake 408 is located in the rear surface in the sheet feeding direction. The heater 409 is provided in a path along which air flows in through the air intake 408. The duct 407 is provided so as to lead the air discharged from the heater 409 to the fans 405 and 406.

Due to this structure, the sheet feeding assisting unit 400 can efficiently take in air from the empty space in the sheet cassette 10 (from the rear in the sheet feeding direction). The air that flows in through the air intake 408 is heated by the heater 409. Thus, by the fans 405 and 406 (air blowing devices), hot air can be blown out through the blowing ports 403*a* and 403*b* provided in a surface parallel to the sheet feeding direction.

The blowing ports 403*a* and 403*b* are provided in the upper part of the sheet feeding assisting unit 400. Since the blowing ports 403*a* and 403*b* are substantially level with the top surface of the stack of sheets, hot air can be blown against the upper part of the side surface of the stack of sheets loaded in the cassette tray 56. The blowing ports 403*a* and 403*b* are provided with a lattice or slits to prevent dust or foreign objects from entering the sheet feeding assisting unit 400.

The procedure to install the sheet feeding assisting unit 400 in the sheet cassette 10 will be described with reference to FIG. 14. First, to install the sheet feeding assisting unit 400, the side positioning plates 51 and 52 provided in the sheet cassette 10 are moved so that the distance therebetween is the maximum. A plurality of positioning holes is provided in the sheet cassette 10 and serves as a mounting mechanism. A protrusion is provided on the bottom surface of the sheet feeding assisting unit 400. The protrusion is fitted into a positioning hole corresponding to the width of the sheets.

In FIG. 14, the sheet feeding assisting unit 400 is installed at the back of the sheet cassette 10, and on the side of the side positioning plate 52. However, the sheet feeding assisting unit 400 may be installed at the front of the sheet cassette 10, and on the side of the side positioning plate 51. Alternatively, the side positioning plate 52 may be detachable. In this case, the sheet feeding assisting unit 400 is installed in the place where the side positioning plate 52 has been detached.

The positioning holes are provided with a sensor that detects which positioning hole the protrusion of the sheet feeding assisting unit 400 is fitted into. With this sensor, the position of the sheet feeding assisting unit 400 can be detected, and therefore the size of the sheets loaded in the sheet cassette 10 can be detected.

The surface of the sheet feeding assisting unit 400 having the blowing ports 403*a* and 403*b* is flat and positions the sheets in the width direction together with the side positioning plate 51. That is to say, as shown in FIG. 15, the sheet feeding assisting unit 400 can be shifted so as to position the sheets in the width direction, with the side restricting plate 51 fixed.

Since the sheets are loaded against one side of the sheet cassette 10, more variable sizes of sheets can be loaded compared to the case where the sheets are loaded in the center of the sheet cassette 10. If the sheets are loaded in the center of the sheet cassette 10 in which the sheet feeding assisting unit 400 is installed, a wasted space having the same width as the sheet feeding assisting unit 400 is formed on the side of the side positioning plate 51, and therefore the size of loadable sheets is limited.

When the sensor detects that the sheet feeding assisting unit 400 is installed, the sensor informs the controller 120. By receiving this information, the controller 120 detects that the sheets are loaded against one side, and accordingly changes the starting position of printing.

Finally, a connector 430 for sending and receiving electrical signals and control signals is coupled to a connecting cable (not shown) in the cassette chamber of the image forming apparatus 900. The connecting cable is, for example, a flexible cable that maintains electrical connection even when the sheet cassette 10 is fully pulled out. Alternatively, electrical connection can be performed only when the sheet cassette 10 is loaded in the image forming apparatus body, using a drawer connector.

In the above description, the protrusion of the sheet feeding assisting unit 400 is fitted into one of the positioning holes provided in the sheet cassette 10. However, the sheet feeding assisting unit 400 may be fixed to a slider that is provided in the sheet cassette 10 and slidable in the width direction. In this case, by sliding the slider, the sheet feeding assisting unit 400 also slides and positions the sheets in the width direction. In addition, the size of the sheets is detected by a sensor that detects the position of the slider. In the above description, the sheet feeding assisting unit 400 is disposed so as to blow air against the side surface of the stack of sheets. However, the present invention is not limited to this. Alternatively, the sheet feeding assisting unit 400 may be disposed so as to blow air against the front surface or the rear surface of the stack of sheets in the sheet feeding direction.

As described above in detail, the embodiments can be applied to relatively small apparatuses. By just installing a sheet feeding assisting unit in the sheet cassette, the apparatuses can separate and feed sheets difficult to separate, such as coated paper.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

What is claimed is:

1. A sheet feeding apparatus for feeding sheets comprising:

a sheet cassette adapted to load sheets;

a sheet feeding member configured to feed the sheets loaded in the sheet cassette;

a sheet feeding assisting unit detachably attached to a sheet loading position where the sheets are loaded in the sheet cassette, wherein the sheet feeding assisting unit has a case where the sheets are loaded, and, when the sheet feeding assisting unit is attached to the sheet cassette, the sheet loaded in the case is fed by the sheet feeding member;

a sheet tray disposed in the case and configured to support the sheets to be fed by the sheet feeding member;

an air blowing mechanism disposed on the case of the sheet feeding assisting unit and operable to blow air against edges of the sheets supported by the sheet tray; and a circulation duct disposed on the case and adapted to return the air blown against the sheets from the air blowing mechanism to the air blowing mechanism.

2. A sheet feeding apparatus for feeding sheets comprising:

a sheet cassette adapted to load sheets;

a sheet feeding member configured to feed the sheets loaded in the sheet cassette;

a sheet feeding assisting unit detachably attached to a sheet loading position where the sheets are loaded in the sheet cassette, wherein the sheet feeding assisting unit has a case where the sheets are loaded, and, when the sheet feeding assisting unit is attached to the sheet cassette, the sheet loaded in the case is fed by the sheet feeding member;

a sheet tray disposed in the case and configured to support the sheets to be fed by the sheet feeding member;

an air blowing mechanism disposed on the case of the sheet feeding assisting unit and operable to blow air against edges of the sheets supported by the sheet tray;

an opening that can pass air, the opening being defined in the inner wall of the case between the air blowing mechanism and a sheet loading space of the case; and an air swinging device configured to swing the air blown against the sheets and being provided at the opening.

3. The sheet feeding apparatus according to claim 1, wherein the air blowing mechanism includes an air heating mechanism configured to heat air to be blown out.

4. The sheet feeding apparatus according to claim 1, wherein the air blowing mechanism includes a fan and a connector electrically connecting the fan to the sheet cassette when the sheet feeding assisting unit is attached to the sheet cassette.

5. An image forming apparatus that forms an image on a sheet, the apparatus comprising:

a sheet cassette adapted to load sheets;

a sheet feeding member configured to feed the sheets loaded in the sheet cassette;

a sheet feeding assisting unit detachably attached to a sheet loading position where the sheets are loaded in the sheet cassette, wherein the sheet feeding assisting unit has a case where the sheets are loaded, and, when the sheet feeding assisting unit is attached to the sheet cassette, the sheet loaded in the case is fed by the sheet feeding member;

a sheet tray disposed in the case configured to support the sheets to be fed by the sheet feeding member;

an air blowing mechanism disposed on the case of the sheet feeding assisting unit and operable to blow air against edges of the sheets supported by the sheet tray;

a circulation duct disposed on the case and adapted to return the air blown against the sheets from the air blowing mechanism to the air blowing mechanism; and an image forming section configured to form an image on a sheet fed by the sheet feeding member.

6. An image forming apparatus that forms an image on a sheet, the apparatus comprising:

a sheet cassette adapted to load sheets;

a sheet feeding member configured to feed the sheets loaded in the sheet cassette;

a sheet feeding assisting unit detachably attached to a sheet loading position where the sheets are loaded in the sheet cassette, wherein the sheet feeding assisting unit has a case where the sheets are loaded, and, when the sheet feeding assisting unit is attached to the sheet cassette, the sheet loaded in the case is fed by the sheet feeding member;

a sheet tray disposed in the case configured to support the sheets to be fed by the sheet feeding member;

an air blowing mechanism disposed on the case of the sheet feeding assisting unit and operable to blow air against edges of the sheets supported by the sheet tray;

an opening that can pass air, the opening being defined in the inner wall of the case between the air blowing mechanism and a sheet loading space of the case;

an air swinging device configured to swing the air blown against the sheets and being provided at the opening; and an image forming section configured to form an image on a sheet fed by the sheet feeding member.

7. The image forming apparatus according to claim 5, wherein the air blowing mechanism includes an air heating mechanism configured to heat air to be blown out.

8. The image forming apparatus according to claim 5, wherein the air blowing mechanism includes a fan and a connector electrically connecting the fan to the sheet cassette when the sheet feeding assisting unit is attached to the sheet cassette.

* * * * *